US007646347B2

(12) United States Patent
Ying

(10) Patent No.: US 7,646,347 B2
(45) Date of Patent: Jan. 12, 2010

(54) ANTENNA FOR A PEN-SHAPED MOBILE PHONE

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 208 days.

(21) Appl. No.: 11/627,471

(22) Filed: Jan. 26, 2007

(65) Prior Publication Data

US 2008/0180344 A1 Jul. 31, 2008

(51) Int. Cl.
*H01Q 1/24* (2006.01)

(52) U.S. Cl. ..... 343/702; 343/848

(58) Field of Classification Search ..... 343/702, 343/829, 846, 848
See application file for complete search history.

(56) References Cited

U.S. PATENT DOCUMENTS

| | | | | |
|---|---|---|---|---|
| 3,071,771 | A * | 1/1963 | Scheldorf | 343/828 |
| 5,418,543 | A * | 5/1995 | Bolton | 343/713 |
| 5,448,253 | A * | 9/1995 | Ponce de Leon et al. | 343/702 |
| 5,673,054 | A | 9/1997 | Hama | |
| 5,724,045 | A * | 3/1998 | Kawakami | 342/357.07 |
| 5,940,041 | A | 8/1999 | Koyama et al. | |
| 5,969,680 | A | 10/1999 | Tsuru et al. | |
| 6,452,554 | B1 | 9/2002 | Aoyama et al. | |
| 6,509,893 | B1 | 1/2003 | Akhlagi et al. | |
| 6,947,762 | B1 | 9/2005 | Kuramoto | |
| 6,963,310 | B2 | 11/2005 | Horita et al. | |
| 7,042,402 | B2 | 5/2006 | Modro | |
| 7,423,598 | B2 * | 9/2008 | Bit-Babik et al. | 343/702 |
| 2001/0002823 | A1 | 6/2001 | Ying | |
| 2002/0068603 | A1 | 6/2002 | Ito et al. | |
| 2004/0012530 | A1 | 1/2004 | Chen | |
| 2004/0070541 | A1 | 4/2004 | Andersson et al. | |
| 2004/0090372 | A1 * | 5/2004 | Nallo et al. | 343/700 MS |
| 2005/0243007 | A1 | 11/2005 | Ke et al. | |
| 2005/0280586 | A1 | 12/2005 | Bit-Babik et al. | |
| 2006/0232482 | A1 | 10/2006 | Chen | |

FOREIGN PATENT DOCUMENTS

| | | |
|---|---|---|
| EP | 1 403 964 A1 | 3/2004 |
| EP | 1 575 123 A1 | 9/2005 |
| GB | 2 293 494 A | 3/1996 |
| JP | 10-32409 | 2/1998 |

OTHER PUBLICATIONS

International Search Report and Written Opinion issued in corresponding international application No. PCT/EP2007/059419 mailed Nov. 08, 2007, 11 pages.

U.S. Appl. No. 11/558,754, filed Nov. 10, 2006; Z. Ying: "Antenna for a Pen-Shaped Mobile Phone", 13 pages, 4 pages of drawings.

* cited by examiner

*Primary Examiner*—Tho G Phan
(74) *Attorney, Agent, or Firm*—Harrity & Harrity, LLP

(57) ABSTRACT

The present invention relates to an antenna arrangement for a thin elongated portable communication device as well as to a thin elongated portable communication device including such an antenna arrangement. The antenna arrangement may include a thin elongated ground plane, and a flat monopole radiating antenna element, the flat monopole radiating antenna element having a three-dimensional extension, being provided spaced from the ground plane along a longitudinal axis of the ground plane and encircling more than half of the longitudinal axis of the ground plane.

23 Claims, 6 Drawing Sheets

ANTENNA FOR A PEN-SHAPED MOBILE PHONE

TECHNICAL FIELD

The present invention relates to antennas and, more particularly, an antenna arrangement for a portable communication device as well as to a thin elongated portable communication device having such an antenna arrangement.

DESCRIPTION OF RELATED ART

Portable communication devices, such as mobile phones, are becoming increasingly smaller and smaller. In relation to such small devices, there are unconventional shapes, dimensions, and designs are furthermore being considered. Thus portable communication devices may now have virtually any shape and/or dimensions.

One type of unconventional type of shape is a pen shape. Pen-shaped devices are present in various related fields. A wireless communication device in the form of a pen is, for instance, the so-called, "C-pen." One type of C-pen is described in U.S. Pat. No. 6,509,893 to Akhlagi et al, in which characters can be optically read from a page by the pen and transferred wirelessly to, for instance, a computer.

When using such a relatively small, elongated portable communication device, it is therefore of interest also to provide a complementary antenna arrangement that is likewise small, can be provided inside such a small device, and still retain good antenna properties for the frequencies that are of interest.

One range of frequencies that is of the interest in such devices is the UWB (ultra-wideband) range of 3.1-10.6 GHz.

In the book "Broadband Planar Antennas: Design and Applications," Zhi Ning Chen and Michael Y. W. Chia: John Wiley & Sons, 2006, pp. 151-193, a number of planar monopole antennas are described.

SUMMARY

The present invention is generally directed to providing an antenna arrangement that is small, may be provided inside a thin, elongated portable communication device and still exhibit superior transmission and reception properties for operable frequencies.

Implementations of the present invention provide an antenna arrangement for a thin, elongated portable communication device that is small, that may be provided inside the device and retain superior antenna properties for the frequencies associated with transmission/reception.

According to a first aspect of the present invention, an antenna arrangement for a thin, elongated portable communication device includes: a thin elongated circuit board including a ground plane, and an antenna arrangement including: a thin elongated ground plane, and a flat monopole radiating antenna element, the flat monopole radiating antenna element having a three-dimensional extension, being provided spaced from the ground plane along a longitudinal axis of the ground plane and encircling more than half of the longitudinal axis of the ground plane.

A second aspect of the present invention is directed to an antenna arrangement including the features of the first aspect, the flat monopole radiating antenna element including a first antenna section, which includes a set of parts comprising at least one part, where the set of parts encircles at least half of the longitudinal axis of the ground plane.

A third aspect of the present invention is directed to an antenna arrangement including the features of the second aspect, the first antenna section further including a feeding part joined to the middle of the set of parts.

A fourth aspect of the present invention is directed to an antenna arrangement including the features of the second aspect, the set of parts being curved around the longitudinal axis.

A fifth aspect of the present invention is directed to an antenna arrangement including the features of the second aspect, the set of parts including three planar parts, where one part is joined to another part at right angles for folding the first antenna section around the longitudinal axis.

A sixth aspect of the present invention is directed to an antenna arrangement including the features of the fifth aspect, the set of parts including a fourth planar part joined at right angles to one of the three planar parts.

A seventh aspect of the present invention is directed to an antenna arrangement including the features of the fifth aspect, the flat monopole radiating antenna element further including a second antenna section provided opposite the middle of the set of parts of the first antenna section in relation to the longitudinal axis.

An eighth aspect of the present invention is directed to an antenna arrangement including the features of the seventh aspect, the second antenna section being planar.

A ninth aspect of the present invention is directed to an antenna arrangement including the features of the seventh aspect, the second antenna section being curved.

A tenth aspect of the present invention is directed to an antenna arrangement including the features of the seventh aspect, further including a strip line connecting the first and second antenna sections.

An eleventh aspect of the present invention is directed to an antenna arrangement including the features of the tenth aspect, the strip line including a section that stretches above and adjacent the middle part of the first antenna section in parallel with the longitudinal axis to obtain coupling to the first antenna section.

A twelfth aspect of the present invention is directed to an antenna arrangement including the features of the eleventh aspect, the whole flat monopole radiating antenna element being dimensioned for obtaining resonance at a first frequency and the first and second antenna sections being dimensioned to be resonating at a second and third frequency, both being higher than the first frequency.

A thirteenth aspect of the present invention is directed to an antenna arrangement including the features of the first aspect, the antenna arrangement being designed to be operated in a ultra wideband (UWB) frequency range of 3.1 to 10.6 GHz.

Other implementations of the present invention provide a thin, elongated portable communication device having an antenna arrangement that is small, that may be provided inside the device and exhibiting good antenna properties for the frequencies that are of interest.

According to a fourteenth aspect of the present invention, a thin, elongated portable communication device including: a thin elongated circuit board including a ground plane, and an antenna arrangement including, a flat monopole radiating antenna element, the flat monopole radiating antenna element having a three-dimensional extension, being provided spaced from the ground plane along a longitudinal axis of the ground plane and encircling more than half of the longitudinal axis of the ground plane.

A fifteenth aspect of the present invention is directed to a portable communication device including the features of the fourteenth aspect, the flat monopole radiating antenna element including a first antenna section, which includes a set of parts including at least one part, where the set of parts encircles at least half of the longitudinal axis of the ground plane.

A sixteenth aspect of the present invention is directed to a portable communication device including the features of the fifteenth aspect, the first antenna section further including a feeding part joined to the middle of the set of parts.

A seventeenth aspect of the present invention is directed to a portable communication device including the features of the fifteenth aspect, the set of parts being curved around the longitudinal axis.

An eighteenth aspect of the present invention is directed to a portable communication device including the features of the fifteenth aspect, the set of parts includes three planar parts, where one part is joined to another part at right angles for folding the first antenna section around the longitudinal axis.

A nineteenth aspect of the present invention is directed to a portable communication device including the features of the eighteenth aspect, the set of parts including a fourth planar part joined at right angles to one of the three planar parts.

A twentieth aspect of the present invention is directed to a portable communication device including the features of the eighteenth aspect, the flat monopole radiating antenna element further including a second antenna section provided opposite the middle of the set of parts of the first antenna section in relation to the longitudinal axis.

A twenty-first aspect of the present invention is directed to a portable communication device including the features of the twentieth aspect, the second antenna section being planar.

A twenty-second aspect of the present invention is directed to a portable communication device including the features of the twentieth aspect, the second antenna section being curved.

A twenty-third aspect of the present invention is directed to a portable communication device including the features of the twentieth aspect, further including a strip line connecting the first and second antenna sections.

A twenty-fourth aspect of the present invention is directed to a portable communication device including the features of the twenty-third aspect, the strip line including a section that stretches above and adjacent the middle part of the first antenna section in parallel with the longitudinal axis to obtain coupling to this section.

A twenty-fifth aspect of the present invention is directed to a portable communication device including the features of the twenty-fourth aspect, the whole flat monopole radiating antenna element being dimensioned for obtaining resonance at a first frequency and the first and second antenna sections being dimensioned to be resonating at a second and third frequency, both being higher than the first frequency.

A twenty-sixth aspect of the present invention is directed to a portable communication device including the features of the fourteenth aspect, the antenna arrangement being designed to be operating in an ultra wideband (UWB) frequency range of 3.1 to 10.6 GHz.

A twenty-seventh aspect of the present invention is directed to a portable communication device including the features of the fourteenth aspect, the portable communication device being a mobile phone.

The invention has a number of advantages, for example, providing a small-sized antenna arrangement that may be provided inside a thin elongated portable communication device and exhibiting good antenna properties for the frequencies that are of interest, while being simply implemented and produced at a low cost.

It should be emphasized that the terms, "comprises/comprising," and "includes/including," when used in this specification, is taken to specify the presence of stated features, integers, steps or components, but does not preclude the presence or addition of one or more other features, integers, steps, components, or groups thereof.

BRIEF DESCRIPTION OF THE DRAWINGS

The present invention will now be described in more detail in relation to the enclosed drawings, in which.

DETAILED DESCRIPTION

Figure 1:
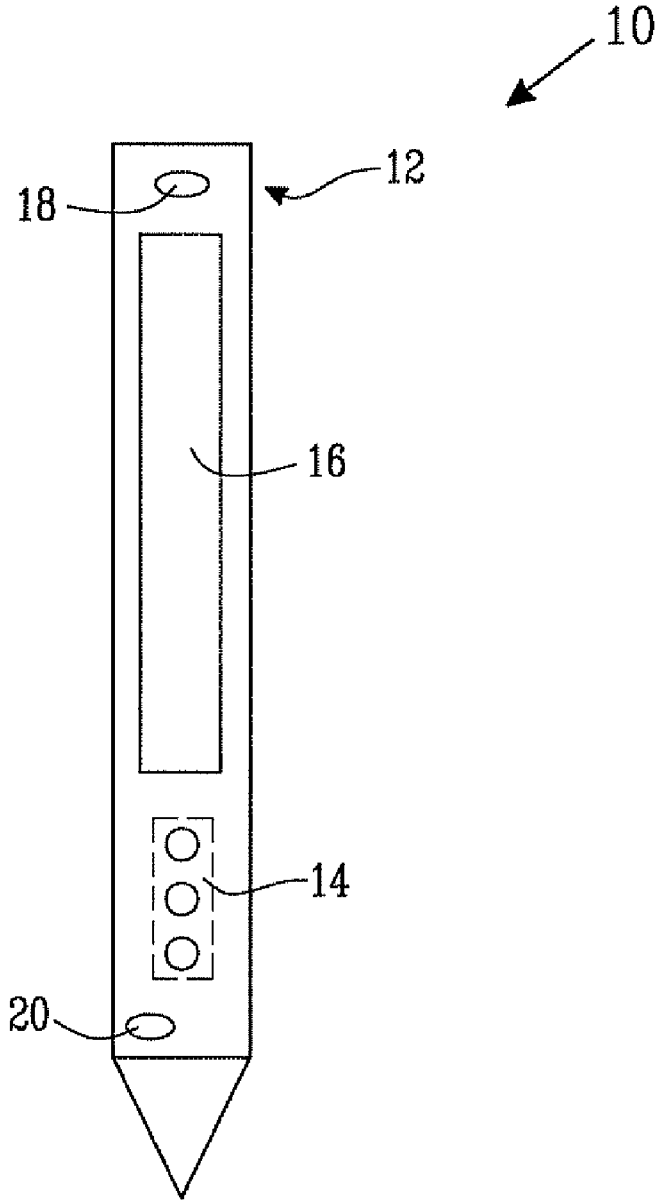
FIG. 1 shows a front view of a portable communication device in which systems and methods described herein may be implemented.

FIG. 1 shows a front view of a portable communication device, such as a phone 10, in the form of a thin, elongated mobile terminal. The shape here is that of a pen. Phone 10 may have a lower end where there may be provided a microphone 20 and a set of tactile user input units 14 in the form of a number of buttons (here three). Input units 14 are here indicated by a dashed box. Phone 10 may include an upper end 12 where a speaker 18 may be provided. In the middle of phone 10, between an upper 12 end and an opposing lower end, a display 16 may be provided. The other different functional units of phone 10 may be provided in the interior of phone 10, i.e., inside the casing or housing.

Phone 10 may include at least one antenna arrangement, which may be provided in the interior of phone 10, i.e., inside the casing. Phone 10 may include other functionality, for instance, optical reading of text. In one implementation, phone 10 may include ink to be used in writing. Phone 10 may include any of the functions normally provided in existing mobile phones, such as a media player or a camera.

Figure 2:
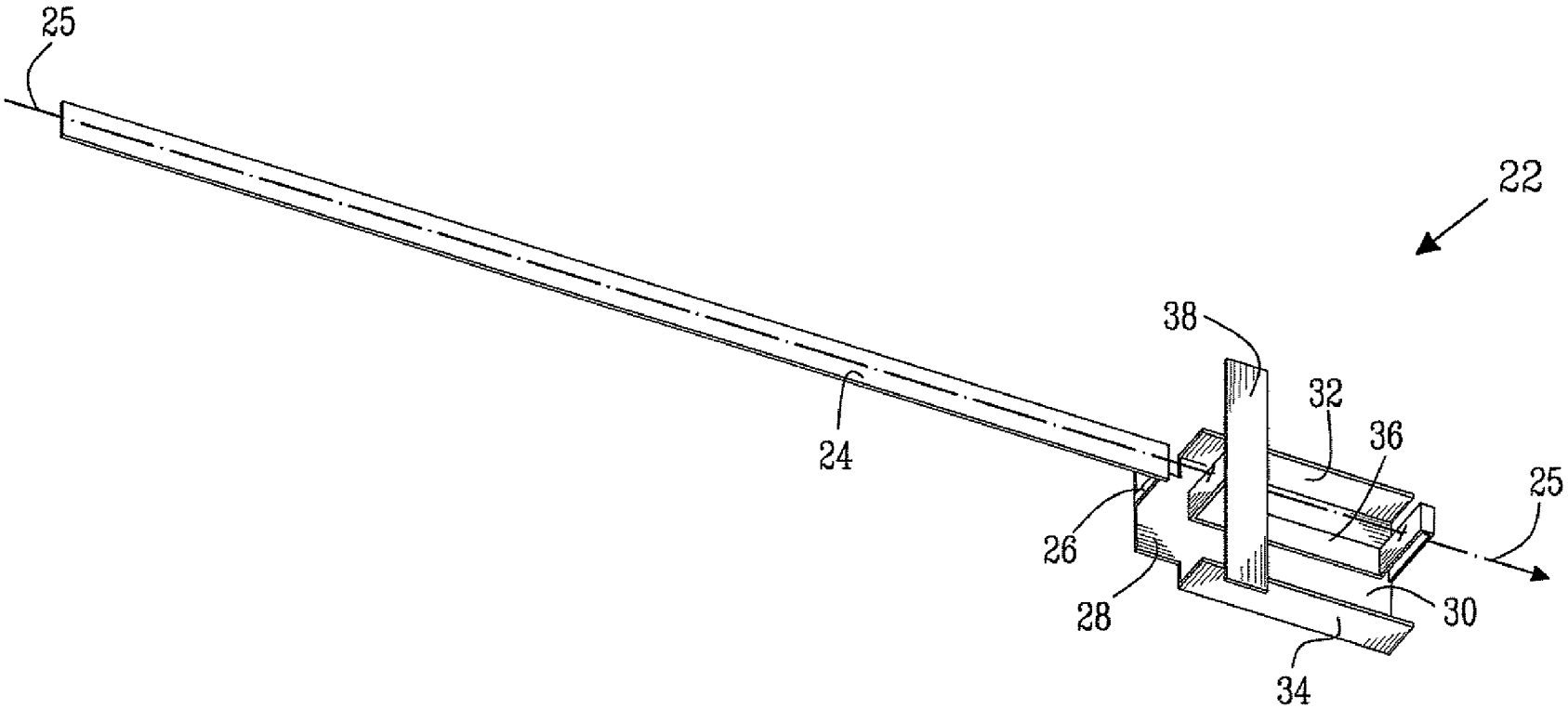
FIG. 2 shows a first perspective view of an exemplary antenna arrangement according to a first embodiment of the present invention.
Figure 3:
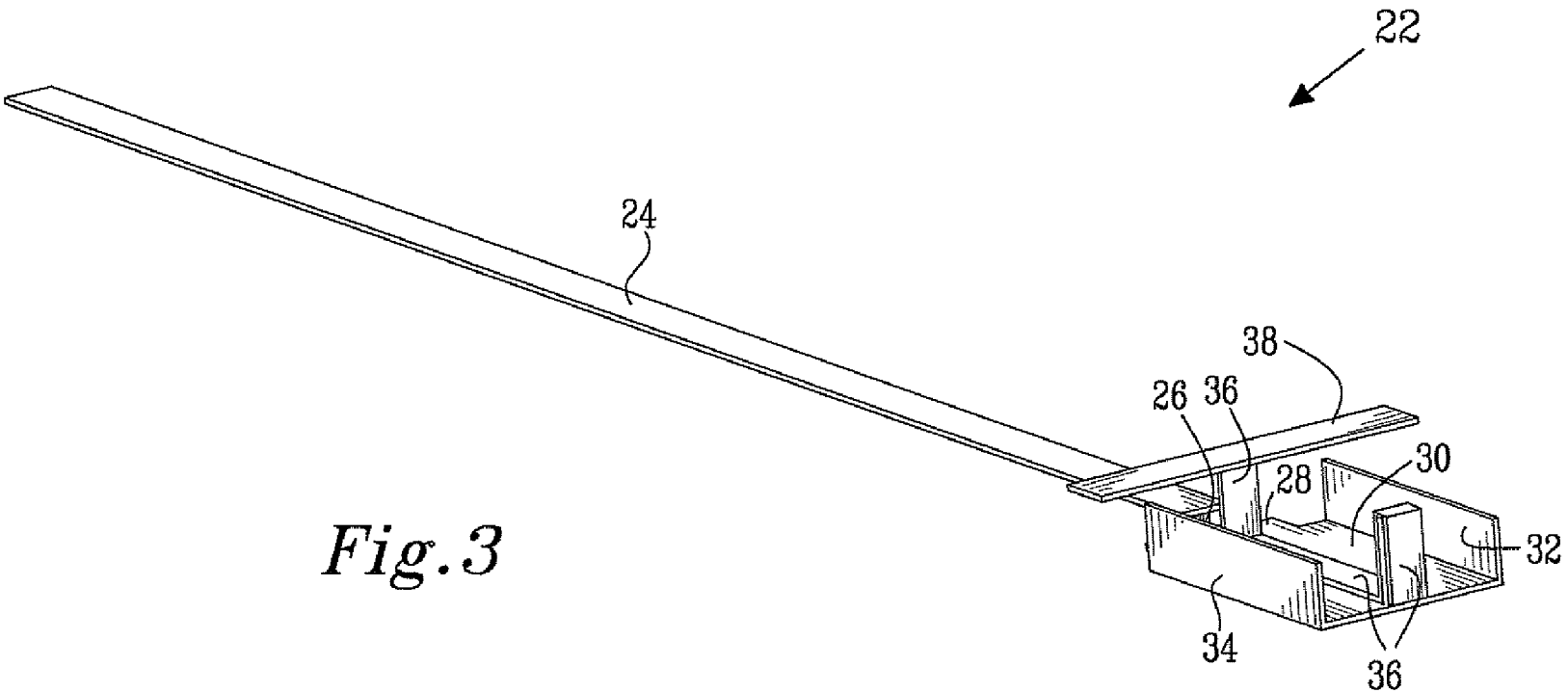
FIG. 3 shows a second perspective view of the exemplary antenna arrangement according to the first embodiment of the present invention.
Figure 4:
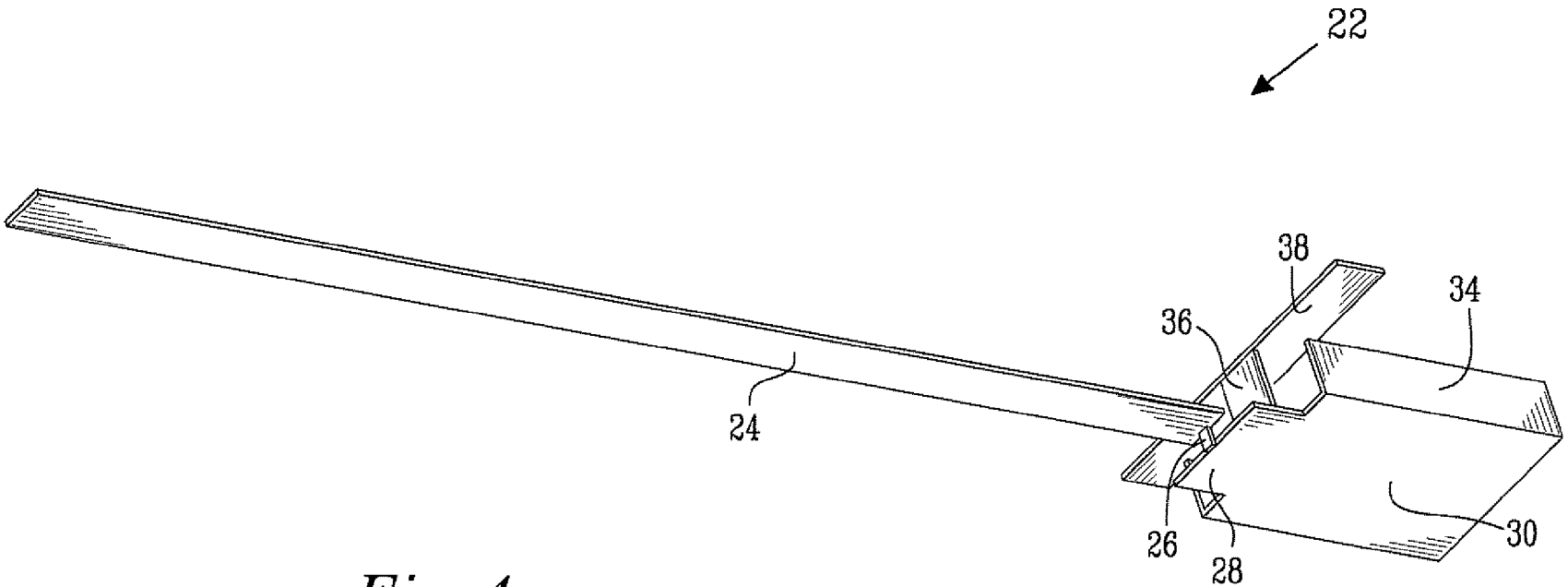
FIG. 4 shows a third perspective view of the exemplary antenna arrangement according to the first embodiment of the present invention.

FIGS. 2-4 shows different perspective views of antenna arrangement 22 according to a first embodiment of the present invention. FIGS. 2 and 3 show different perspective views of the antenna arrangement from above, while FIG. 4 shows a perspective view from below.

Antenna arrangement 22 includes a thin elongated ground plane 24, which may be provided in the circuit board (not shown) of phone 10. There is provided a longitudinal axis 25 along the length and through the middle of ground plane 24. The board and ground plane 24 may extend substantially throughout the length of the casing. On the board may be provided a radio circuit (not shown) arranged to feed antenna arrangement 22 with signals. The signals may be provided in the ultra wideband (UWB) frequency range, for example, in the range of from about 3.1 to 10.6 GHz, which is a range that has recently become of interest for many mobile phone functions.

Antenna arrangement 22 may include a flat monopole radiating antenna element that has a three-dimensional extension (i.e., occupying a three-dimensional space), provided at a distance from ground plane 24 along longitudinal axis 25 and encircling, for example, more than half of axis 25. In one implementation, the structure may encircle axis 25 almost entirely, i.e., at least a part of the flat monopole radiating antenna element may be provided closest to ground plane 24 in the direction of axis 25, covering almost a whole turn around axis 25 in cylindrical fashion, where the remainder of the structure essentially covers about half of a turn.

The flat monopole radiating antenna element may be provided at upper end 12 of phone 10. In one implementation of the present invention, the flat monopole radiating antenna element may include a first antenna section that includes a set of parts that encircles approximately half axis 25, i.e., the set of parts may cover approximately half of a turn around axis 25 in a cylindrical fashion. The set may include a first flat, for example, essentially rectangular, middle part 30 which may be provided in a plane substantially parallel with ground plane 24 and distanced from axis 25. The first part may be joined, at a side that extends in the direction of the axis 25, at right angles to a second flat lateral part 32, which second part 32 may extend from middle part 30 to the plane in which ground plane 24 is provided. First middle part 30 may, at an opposite side, which may extend in the direction of axis 25, be joined at right angles to a third flat lateral part 34, which third part 34 may extend from middle part 30 to the plane in which ground plane 24 is provided. In the above-described configuration, the set of parts including middle part 30, second flat lateral part 32, and third flat lateral part 34 together may form half of an open-ended box with a substantially rectangular cross-section that is provided half a turn around axis 25.

Middle part 30 of this set may be joined to an essentially rectangular flat feeding part 28, which may be co-planar with middle part 30 and provided in the direction of ground plane 24. Middle part 30, second flat lateral part 32, and third flat lateral part 34 and feeding part 28, for example, together may form a first antenna section. Middle part 30, second flat lateral part 32, third flat lateral part 34, and feeding part 28, may be at a distance from ground plane 24 in the longitudinal direction (i.e., axis 25), the distance being determined by the width of feeding part 28. A feeding connector 26 for connection to the previously mentioned radio circuit to supply antenna signals to the flat monopole radiating antenna element may be provided.

A monopole antenna according to one embodiment may include a second antenna section 38. Second antenna section 38, for example, may be provided as an essentially flat or planar rectangular section. Second antenna section 38 may be provided opposite middle part 30 of the set of parts of the first antenna section in relation to axis 25. Second antenna section 38 may be provided opposite the end of middle part 30 that is closest to ground plane 24. Second antenna section 38, for example, may be provided at a distance from axis 25, for example, as much as the casing of phone 10 may allow. The first antenna section may be provided at a distance from axis 25, for example, as much as the casing may allow.

A strip line 36 may be provided that runs between the first antenna section and second antenna section 38. Strip line 36 may be connected to the center of a side of middle part 30 of the set of parts of the first antenna section that is furthest from ground plane 24, from where strip line 36 may extend up to and past axis 25 up into the plane in which second antenna section 38 is provided, where strip line 36 may be folded substantially by 90 degrees and then may stretch a short distance to ground plane 24. Then strip line 36 may again be folded substantially by 90 degrees and may extend back past axis 25 to middle part 30 of the set parts of the first antenna section. However, strip line 36 may contact middle part 30. Instead, strip line 36 may again be folded substantially by 90 degrees adjacent and a short distance above middle part 30 and run in parallel with axis 25 above middle part 30 to ground plane 38. The part of strip line 36 that may be provided adjacent and spaced with a small gap from middle part 30, for example, may denote a coupling section of strip line 36. As strip line 36 then reaches the end of middle part 30 that is closest to ground plane 24, strip line 36 may again be folded substantially by 90 degrees and again may extend to and past axis 25 and connect to second antenna section 38.

The entire monopole antenna element, i.e., the first antenna section and second antenna section 38 together with strip line 36, for example, may be dimensioned for obtaining resonance at a first lowermost frequency, which may lie around 3.1 GHz, while the first antenna section and second antenna section 38 may be designed to be resonating at a second and third resonating frequency, respectively. For example, the second frequency may be higher than the first frequency and the third frequency may be higher than the second frequency. The coupling between the coupling section of strip line 36 and the first antenna section may furthermore provide harmonics of these resonating frequencies, which may provide improved broadband properties.

Figure 5:
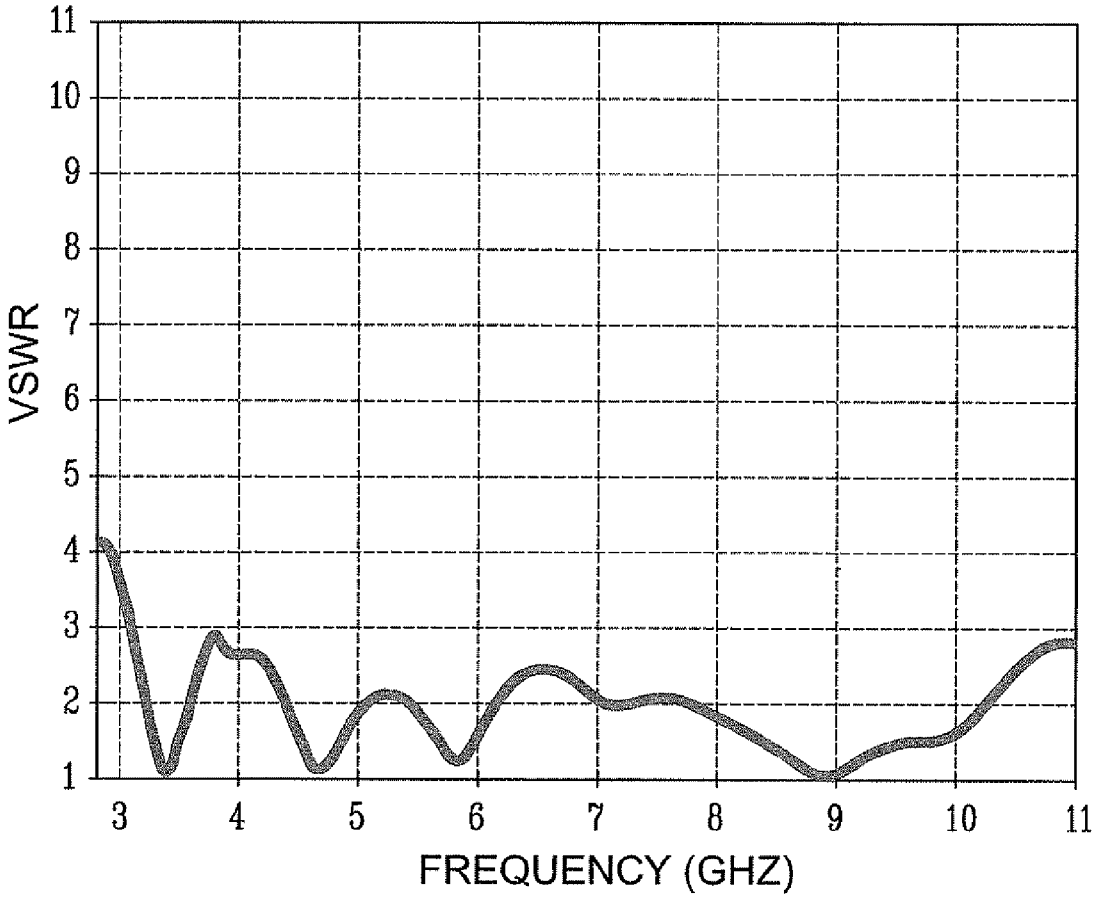
FIG. 5 shows a VSWR chart of the exemplary antenna arrangement according to the first embodiment.

An antenna arrangement according to the present invention may be small in size and fitted in a pen-shaped mobile phone, or other type of mobile terminal. The antenna arrangement may exhibit broadband properties in the UWB frequency range, as can be seen from FIG. 5, which shows a simulated VSWR (voltage standing wave ratio) curve for the antenna arrangement of FIGS. 2-4. As can be seen, the performance is very good for the frequencies. As can be seen, the curve has multiple resonances that helps reduce peaks in the curve, for providing good broadband properties.

It should be appreciated that implementations described herein may be varied in a number of ways. For example, it should be appreciated that the set of parts in the first antenna section may be angled with other angles in relation to each other. The set of parts may also include only one part, which may be curved to provide a section that is provided as half of a cylinder with circular or elliptical cross-section. The first antenna section may furthermore stretch up beyond the longitudinal axis. Further, the second section, for example, may be folded or curved.

Figure 6:
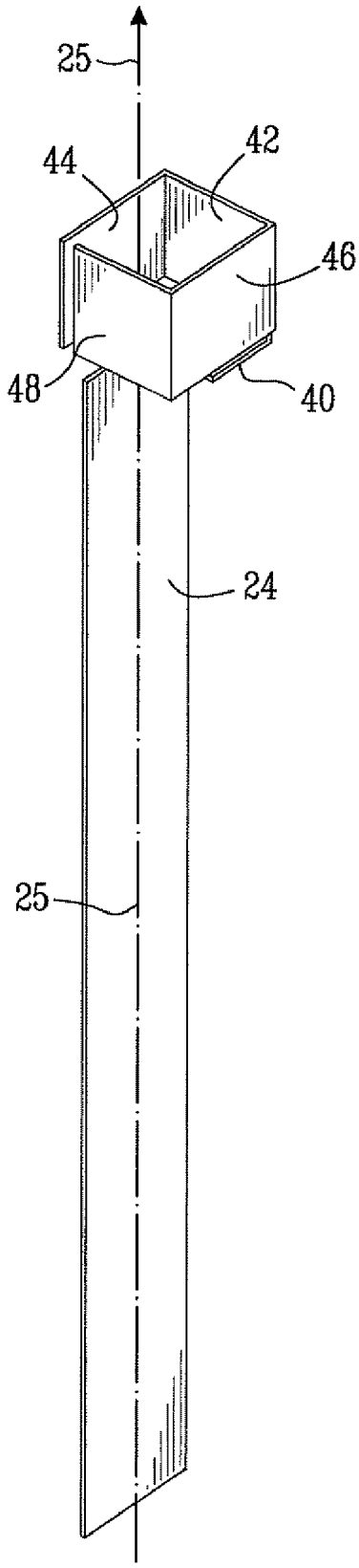
FIG. 6 schematically shows a perspective view of an exemplary antenna arrangement according to a second embodiment of the present invention.

FIG. 6 shows a perspective view of an antenna arrangement according to a second embodiment of the present invention. For example, no second antenna section or strip line is provided, but only a first antenna section including a feeding part 40 connected to a set of parts, including a first middle part 42 and second and third lateral parts 44 and 46 in a similar manner to the previously described embodiment. For example, the first antenna section may be turned in relation to ground plane 24, so that middle part 42 is provided in a plane that is perpendicular to the plane in which ground plane 24 is provided. The second and third parts 44, 46 may extend above longitudinal axis 25 and the third part 46 may be joined at right angles to a fourth part 48 that may extend to second part 44, leaving a gap between them that runs in parallel with longitudinal axis 25 of ground plane 24. In this way, the set of parts may essentially provide an open ended box with a rectangular or quadratic cross-section. Also this embodiment can be varied such that the set up parts is provided as only one part that is curved for providing a cylinder, provided with a longitudinal gap, which cylinder has a circular or a cylindrical cross-section.

It should here be appreciated that the antenna arrangement described herein may be modified in several ways. The first radiating antenna element may have any arbitrary cylinder shape. It should also be appreciated that if further types of communication are needed, the pen-shaped phone may include more antennae for these types of communications, for instance mobile communication or short-range communication, like Bluetooth™ communication. The portable communication device is not limited to being a phone or an optical reading device, but may be any type of portable communication device that need to communicate with other entities. Therefore the present invention is only to be limited by the following claims.

What is claimed is:

1. An antenna arrangement for an elongated portable communication device, comprising:

an elongated ground plane having a longitudinal axis; and a flat monopole radiating antenna element having a three-dimensional extension, where the flat monopole radiating antenna element is disposed at a distance from the ground plane along the longitudinal axis of the ground plane and includes a first antenna section including a set of parts that encircles at least half of the longitudinal axis of the ground plane, where the antenna arrangement is configured to operate in an ultra wideband (UWB) frequency range of from about 3.1 to about 10.6 GHz.

2. The antenna arrangement of claim 1, where the first antenna section further comprises a feeding part joined to a middle part of the set of parts.

3. The antenna arrangement of claim 1, the set of parts being curved around the longitudinal axis.

4. The antenna arrangement of claim 1, where the set of parts comprises three planar parts, where one part is joined to another part at substantially right angles for folding the first antenna section around the longitudinal axis.

5. The antenna arrangement of claim 4, where said set of parts comprises a fourth planar part joined at a substantially right angle to one of the three planar parts.

6. The antenna arrangement of claim 1, where the flat monopole radiating antenna element further comprises a second antenna section provided opposite a middle part of the set of parts of the first antenna section relative to the longitudinal axis.

7. The antenna arrangement of claim 6, the second antenna section being planar.

8. The antenna arrangement of claim 6, the second antenna section being curved.

9. The antenna arrangement of claim 6, further comprising a strip line connecting the first and second antenna sections.

10. The antenna arrangement of claim 9, where the strip line includes a section that extends above and adjacent the middle part of the first antenna section in parallel with the longitudinal axis to couple to the first antenna section.

11. The antenna arrangement of claim 10, where the flat monopole radiating antenna element is configured to resonate at a first frequency and the first and second antenna sections are configured to resonate at a second and third frequency, the second and third frequencies being higher than the first frequency.

12. An elongated portable communication device comprising:

a thin elongated circuit board including a ground plane; and an antenna arrangement including a flat monopole radiating antenna element, where the flat monopole radiating antenna element has a three-dimensional extension, is provided spaced from the ground plane along a longitudinal axis of the ground plane and includes a first antenna section including a set of parts that encircles at least half of the longitudinal axis of the ground plane, where the antenna arrangement is configured to operate in an ultra wideband (UWB) frequency range of from about 3.1 to about 10.6 GHz.

13. The portable communication device of claim 12, where the first antenna section further comprises a feeding part joined to a middle part of the set of parts.

14. The portable communication device of claim 12, the set of parts being curved around the longitudinal axis.

15. The portable communication device of claim 12, where the set of parts comprises three planar parts, where one part is joined to another part at substantially right angles for folding the first antenna section around the longitudinal axis.

16. The portable communication device of claim 15, where the set of parts comprises a fourth planar part joined at a substantially right angle to one of the three planar parts.

17. The portable communication device of claim 15, where the flat monopole radiating antenna element further comprises a second antenna section provided opposite a middle part of the set of parts of the first antenna section relative to the longitudinal axis.

18. The portable communication device of claim 17, the second antenna section being planar.

19. The portable communication device of claim 17, the second antenna section being curved.

20. The portable communication device of claim 17, further comprising a strip line connecting the first and second antenna sections.

21. The portable communication device of claim 20, where the strip line includes a section that extends above and adjacent a middle part of the first antenna section in parallel with the longitudinal axis to couple to the first antenna section.

22. The portable communication device of claim 21, where the flat monopole radiating antenna element is configured to resonate at a first frequency and the first and second antenna sections are configured to resonate at a second and third frequency, the second and third frequencies being higher than the first frequency.

23. The portable communication device of claim 12, where the portable communication device is a mobile phone.

* * * * *